US007310856B2

(12) United States Patent
Temburg

(10) Patent No.: US 7,310,856 B2
(45) Date of Patent: Dec. 25, 2007

(54) APPARATUS AT A DRAW FRAME FOR SUPPLYING FIBRE SLIVERS TO A DRAWING MECHANISM COMPRISING AT LEAST TWO PAIRS OF ROLLERS

(75) Inventor: Josef Temburg, Jüchen (DE)

(73) Assignee: Truetzschler GmbH & Co. KG, Monchengladbach (DE)

( * ) Notice: Subject to any disclaimer, the term of this patent is extended or adjusted under 35 U.S.C. 154(b) by 506 days.

(21) Appl. No.: 10/953,191

(22) Filed: Sep. 30, 2004

(65) Prior Publication Data

US 2005/0076476 A1 Apr. 14, 2005

(30) Foreign Application Priority Data

Oct. 10, 2003 (DE) ..... 103 47 811

(51) Int. Cl.
*D01H 5/00* (2006.01)

(52) U.S. Cl. ..... 19/257

(58) Field of Classification Search ..... 19/243, 19/257, 258, 288

See application file for complete search history.

(56) References Cited

U.S. PATENT DOCUMENTS 3,994,046 A * 11/1976 Brown et al. ..... 19/150
5,023,976 A * 6/1991 Meyer et al. ..... 19/0.25
5,161,284 A * 11/1992 Leifeld ..... 19/260
5,630,251 A * 5/1997 Leifeld ..... 19/291
5,943,740 A * 8/1999 Slavik et al. ..... 19/239
5,983,456 A * 11/1999 Leifeld ..... 19/150
6,295,699 B1 * 10/2001 Temburg ..... 19/239

FOREIGN PATENT DOCUMENTS

DE 8 51 010 B 9/1952
DE 198 09 875 A1 9/1999
FR 1 219 217 5/1960

* cited by examiner

*Primary Examiner*—Shaun R. Hurley
(74) *Attorney, Agent, or Firm*—Venable LLP; Robert Kinberg; Steven J. Schwarz

(57) ABSTRACT

A draw frame has a drawing mechanism comprising at least two pairs of rollers to which the fibre slivers are fed by a plurality of supply rollers mounted on a feed table. The fibre slivers—seen in a top view—run next to one another and towards one another laterally, and a guide element is provided between a feed table and the drawing mechanism, the lateral faces of which guide element are capable of directing the incoming fibre slivers laterally.

In order to allow uniform transfer of the slivers and to enable the slivers to be oriented substantially in a plane, a sliver-guiding device is arranged across the width upstream of the guide element at a spacing therefrom at which the fibre slivers are arranged substantially in a plane, the fibre slivers passing through underneath and in contact with the sliver-guiding device.

21 Claims, 5 Drawing Sheets

APPARATUS AT A DRAW FRAME FOR SUPPLYING FIBRE SLIVERS TO A DRAWING MECHANISM COMPRISING AT LEAST TWO PAIRS OF ROLLERS

CROSS REFERENCE TO RELATED APPLICATION

This application claims priority from German Patent Application No. 103 47 811.6 filed Oct. 10, 2003, the entire disclosure of which is incorporated herein by reference.

BACKGROUND OF THE INVENTION

The invention relates to an apparatus at a draw frame for supplying fibre slivers to a drawing mechanism comprising at least two pairs of rollers.

In a known form of draw frame, the fibre slivers are fed to the drawing mechanism by a plurality of supply rollers mounted on a feed table, the fibre slivers—seen in a top view—running next to one another and towards one another laterally, and a guide element being provided between the feed table and the drawing mechanism, the lateral faces of which guide element are capable of directing the incoming fibre slivers laterally. In a known apparatus, the guide element has two lateral faces which taper in towards one another, as a result of which the fibre slivers are guided laterally. In that arrangement, it happens that the fibre slivers arranged towards the outside are folded over one another. The fibre slivers are displaced upwards so that—in a side view—they are at different heights from one another, which can impair uniform transfer of the slivers and, especially, their horizontal orientation.

Where the guide element includes, or is in the form of, a sliver thickness measuring element, sliver measurement can be impaired by the slivers' being folded over one another.

It is an aim of the invention to provide an apparatus of the kind described at the beginning that avoids or mitigates the mentioned disadvantages and, especially, that allows uniform transfer of the slivers and enables the slivers to be oriented substantially in a plane.

SUMMARY OF THE INVENTION

The invention provides a draw frame having a drawing mechanism;

a feed table having a plurality of supply rollers for feeding a plurality of slivers laterally spaced from one another;

a guide element located between the table and the drawing mechanism, said guide element having lateral faces for tending to cause convergence of laterally spaced slivers passing through the guide element in a direction towards said drawing mechanism;

and a sliver-guiding device located upstream of the guide element and comprising a guide surface that extends across the path of the slivers;

the arrangement being such that in use the travelling slivers are in contact with the guide surface of the sliver-guiding device.

As a result of the sliver-guiding device according to the invention, the fibre slivers are held down at a location in which they are still oriented substantially in a plane, that is to say in which the slivers arranged to the outside have not yet been folded over upon themselves and over slivers arranged further to the inside. As a result it is ensured that the group of fibre slivers has a level orientation, which is important for entry into the nip of the pair of take-in rollers of the drawing mechanism. When a measuring element for determining thickness variations either in the fibre sliver group consisting of several slivers or for individual sliver measurement is provided between the feed table and the drawing mechanism, measuring the fibre slivers next to one another in a plane is highly advantageous. It is also advantageous for the apparatus according to the invention to be provided upstream of the drawing mechanism, upstream of the measuring element and/or upstream of a guide element directing the fibre slivers laterally.

The spacing between the sliver-guiding device and the guide element may be, for example, from about 5 mm to about 40 mm, preferably 10 to 15 mm. Advantageously, the sliver-guiding device is of elongate construction. Advantageously, the sliver-guiding device is in the form of a bar or the like. The sliver-guiding device may be made from, for example, steel. The sliver-guiding device may be of, for example, circular, semi-circular or oval cross-section. The sliver-guiding device is advantageously rounded off on the face thereof which is in contact with the slivers. The sliver-guiding device advantageously has a smooth surface on that face thereof which is in contact with the slivers. Advantageously, the face which is in contact extends parallel to the fibre slivers. Advantageously, the fibre slivers—seen in a side view—are at an obtuse angle before and after the sliver-guiding means. The sliver-guiding device is mounted in the region of each of its two ends. Advantageously, the sliver-guiding device is adjustable in the height direction by means of an adjusting device. In one embodiment of the invention, the sliver-guiding device is eccentrically mounted. Advantageously, the sliver-guiding device is adjustable for different sliver finenesses. Advantageously, the sliver-guiding device is of two-part construction, the fibre slivers passing through an elongate gap between the two parts. Advantageously, the slivers—seen in a top view—run at an angle relative to the longitudinal axis of the sliver-guiding device. Advantageously, the outer surface of the sliver-guiding device is cylindrical. Advantageously, the outer surface is concavely recessed over its length. In certain embodiments of the invention, the guide element is the tapering sliver guide of the draw frame. The sliver guide is then advantageously in the form of a thickness-sensing apparatus, for example a measurement funnel having a mechanical sensing lever. Instead, there may be arranged downstream of the sliver a thickness-sensing apparatus, for example tongue and groove sensing rollers (draw-off rollers).

In certain further embodiments of the invention, the guide element may be in a form for individual sliver sensing. For example, a microwave sensing device maybe used for individual sliver sensing. Advantageously, there is arranged upstream of the guide element a pre-former, which is capable of bringing together laterally the fibre slivers entering the guide element and of directing them. Advantageously, the sliver-guiding device is in the form of a holding-down device.

The invention also provides an apparatus at a draw frame for supplying fibre slivers to a drawing mechanism comprising at least two pairs of rollers, wherein the fibre slivers are fed to the drawing mechanism by a plurality of supply rollers mounted on a feed table, the fibre slivers—seen in a top view—running next to one another and towards one another laterally, and a guide element being provided between the feed table and the drawing mechanism, the lateral faces of which guide element are capable of directing the incoming fibre slivers laterally, wherein a sliver-guiding device is arranged across the width upstream of the guide element at a spacing therefrom at which the fibre slivers are arranged substantially in a plane, the fibre slivers passing through beneath and in contact with the sliver-guiding device.

The invention also provides a method of guiding a group of fibre slivers, comprising advancing the fibre slivers along a first path length in which they are parallel to one another, further advancing the fibre slivers along a second path length in which they are convergent towards on another, in a common plane, and subsequently advancing the fibre slivers along a third path length in which they are parallel to one another with a lesser spacing between the adjacent slivers than in said first path length, wherein the slivers in said second path length are substantially retained in said common plane by a sliver guiding device that contacts the slivers at a location along said second path length.

BRIEF DESCRIPTION OF THE DRAWINGS

FIG. 1*b* is a top view of the draw frame of FIG. 1*a;*

DETAILED DESCRIPTION OF PREFERRED EMBODIMENTS

Figure 1A:
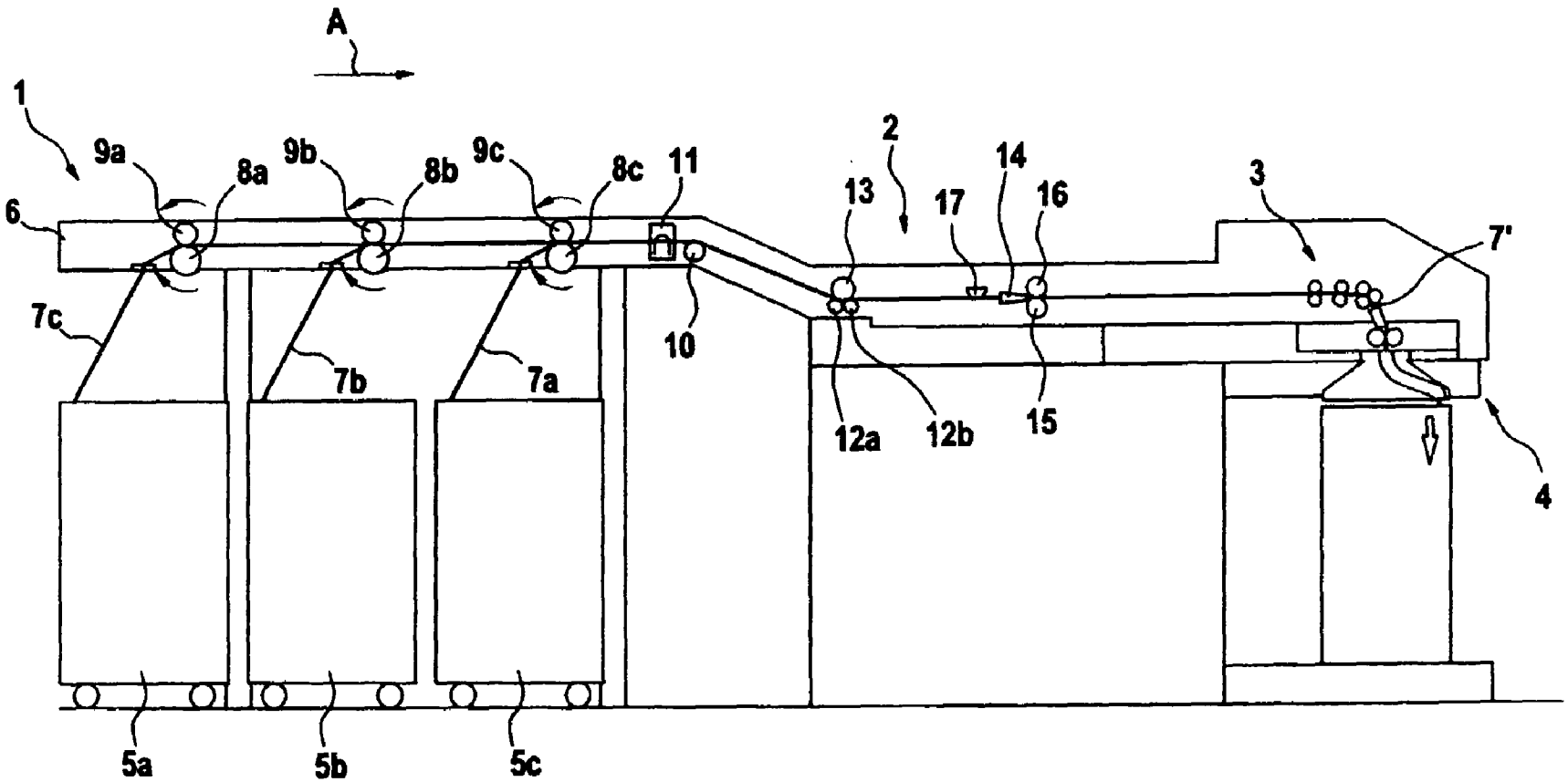
FIG. 1*a* is a diagrammatic side view of a draw frame with an apparatus according to the invention between the feed table and the drawing mechanism.

With reference to FIG. 1*a*, a draw frame, for example a TD 03 draw frame made by Trutzschler GmbH & Co. KG of Monchengladbach, Germany, has a feed region 1, a measurement region 2, a drawing mechanism 3 and a sliver coiling arrangement 4. In the feed region 1, spinning cans 5*a* to 5*c* (circular cans) of a draw frame are arranged below the sliver feed table 6 (creel) in two rows of cans (see FIG. 1*b*), each row having three cans in the embodiment shown; the feed slivers 7*a* to 7*f* are drawn off by means of supply rollers 8*a* to 8*f* and supplied to the drawing mechanism 3. With each driven supply roller 8*a* to 8*f* there is associated a top roller 9*a* to 9*f* (only 9*a* to 9*c* can be seen in the drawings), which rotates together with the supply roller. Located in the region of the feed table are six roller pairs 8*a* to 8*f*, and 9*a* to 9*f*, respectively (cf. FIG. 1*b*), each consisting of a top roller and a supply roller. Fibre slivers 7*a* to 7*f* are lifted out of the spinning cans 5*a* to 5*f* and guided on the feed table 6 towards the draw frame. After passing through the drawing mechanism 3, the attenuated fibre sliver 7' reaches a revolving plate of a can coiler and is deposited in rings in the delivery can. The feed table 6 extends over the region of the entire sliver feed apparatus as far as the draw frame. One fibre sliver 7 is supplied to the draw frame from each of the spinning cans 5 by means of the fibre sliver feed apparatus. In each case, supply is carried out through a sliver feed location, each sliver feed location having a roller pair 8*a*, 9*a*; 8*b*, 9*b*; 8*c*, 9*c* (roller feed). In the region of each lower roller 8*a* to 8*f*, there is a guide member (not shown) for guiding the fibre slivers 7. Reference letter A denotes the running direction of the fibre slivers 8*a* to 8*f*. The fibre slivers 7*a* to 7*f* are nipped between the roller pairs 8*a* to 8*f*, 9*a* to 9*f*. Curved arrows denote the direction of rotation of the supply rollers 8*a* to 8*f* and the top rollers 9*a*to 9*f*. Each supply roller 8*a* to 8*f* is connected to a drive device. At the exit from the feed table 6 there is provided a guide device for the fibre slivers 7*a* to 7*f*, which guide device consists of a horizontal rod 10 of cylindrical cross-section, on the rear face of which there are fixed eight cylinders 11*a* to 11*h*. The axes of the cylinders 11*a* to 11*h* are oriented vertically and the spacing between the outer surfaces of the cylinders 11*a* to 11*h* is large enough for a fibre sliver 7*a* to 7*f* to pass through in each case without being impeded in its running. By that means, guide grooves which are open to the top are formed for the fibre slivers 7*a* to 7*f*, that is to say the cylinders 11*a* to 11*h* have the function of guide members. Arranged downstream from the feed table 6 at the entry to the draw frame is a driven roller arrangement, for example two lower rider rollers 12*a*, 12*b* and three upper rider rollers 13. Referring to FIG. 1*b*, on each side of the feed table 6 there is set out a row of three spinning cans 5 (not shown), each parallel to the other. In operation, a fibre sliver 7 can be drawn out of all six spinning cans 5 at the same time. In operation, it is, however, also possible so to proceed that the fibre sliver 7 is drawn off on only one side, for example from the three spinning cans 5*a* to 5*c*, while the three spinning cans 5*d* to 5*f* on the other side are being replaced. Furthermore, on each side of the feed table 6, there are three supply rollers 8*a*, 8*b*, 8*c* and 8*d*, 8*e*, 8*f*, in each case arranged behind one another in the working direction A. Two supply rollers 8*a*, 8*d*; 8*b*, 8*e*; 8*c*, 8*f* are, in each case, arranged coaxially with respect to one another. The supply rollers 8*a* to 8*f* have the same diameter, for example 100 mm. The speeds of rotation n of the supply rollers decrease in the working direction A, that is to say $n_1>n_2>n_3$. In that manner, the circumferential speeds U of the supply rollers 8*a*-8*f* decrease in the working direction A. As a result, it is possible to adjust individually the circumferential speeds $U_1$, $U_2$, $U_3$ of the supply rollers 8*a*-8*f* so that the feed tensioning of all the fibre slivers 7 can be as desired. The supply rollers 8*a*-8*f* can be driven by way of gear trains or like transmission devices (not shown). The supply rollers 8*a*-8*f* are, in each case, of two-part construction (in a manner known per se) and are of lengths that differ from one another. The length of the fibre slivers 7 in the feed region 1 decreases from the inside towards the outside. According to FIGS. 1*a*, 1*b*, the fibre slivers 7*a* to 7*f* run from the feed table 6 of the feed region 1, by way of the guide device (rod 10, cylinders 11*a* to 11*c*), through the rider roller arrangement 12, 13, through a sliver guide 14 (including the measuring device) having transport rollers 15, 16, through the drawing mechanism 3, through a web guide, a sliver funnel draw-off rollers and a rotating plate, and into a can.

FIG. 1*b* shows the rollers that are arranged, in each case, on the underneath side, 8*a* to 8*f*, 12*a*, 12*b*, 15, III, II and I. According to FIG. 1*b*, the fibre sliver 7' comprising six fibre slivers 7 is subjected to entry creel tensioning in the region between the roller pairs 8*a*-8*f*, 9*a*-9*f* and the rider roller apparatus 12, 13; to rider roller tensioning in the region between the rider roller arrangement 12, 13 and the transport rollers 15, 16; and to transport roller tensioning in the region between the transport rollers 15, 16 and the intake rollers 26, 1111 of the drawing mechanism 3.

As FIG. 1*b* shows in a top view, the fibre slivers 7*a* to 7*f* run towards one another between the cylinders 11*a* to 11*h* and the draw-off rollers 15,16. In the process, the fibre slivers 7*a* to 7*f* run towards one another in a first step between the cylinders 11*a* to 11*h* and the entry to the sliver guide 14 (guide element) and are brought further in towards one another by the conically tapering side walls of the sliver guide 14. A sliver-guiding means 17 (holding-down means) is arranged across the width upstream of the sliver guide 14 at a spacing a therefrom at which the fibre slivers 7*a* to 7*f* are arranged substantially in a plane (see FIG. 1*a*), that is to say the outer fibre slivers 7*c* and 7*f* have not been folded over upon themselves. The spacing a can be, for example, about from 5 to 40 mm, preferably from 10 to 15 mm. The sliver-guiding means 17 is in the form of a bar, is rounded off on its underside and has a smooth surface.

Figure 2:
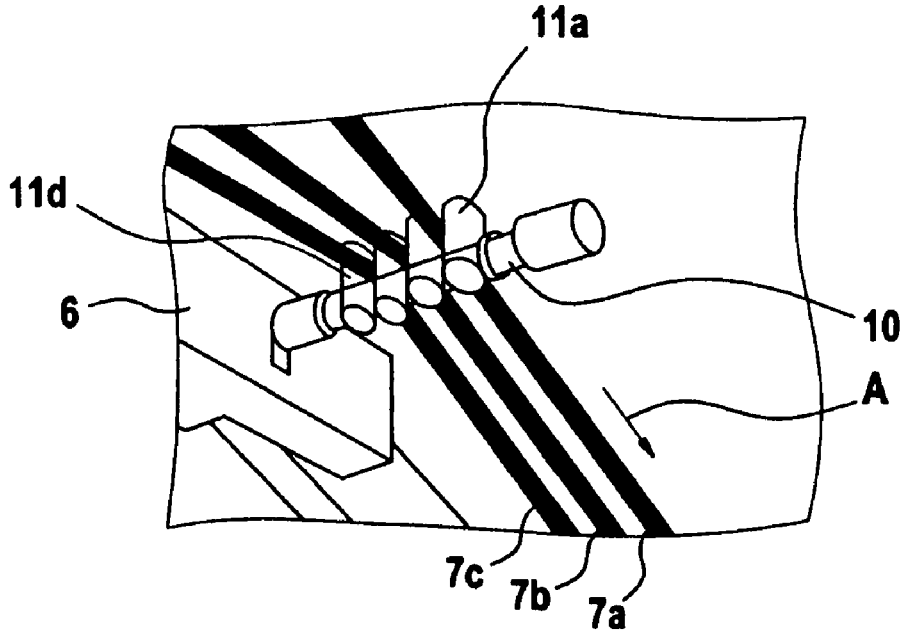
FIG. 2 is a perspective view of a guidance mechanism for the fibre slivers at the exit from the feed table.

With reference to FIG. 2, at the end of the draw frame creel, the fibre slivers 7*a* to 7*c* are passed through the guide grooves, which are open to the top, between the guide members 11*a* to 11*d*. The fibre slivers 7*a* to 7*c*—seen in the work direction A—run towards one another in somewhat tapering manner.

Figure 3:
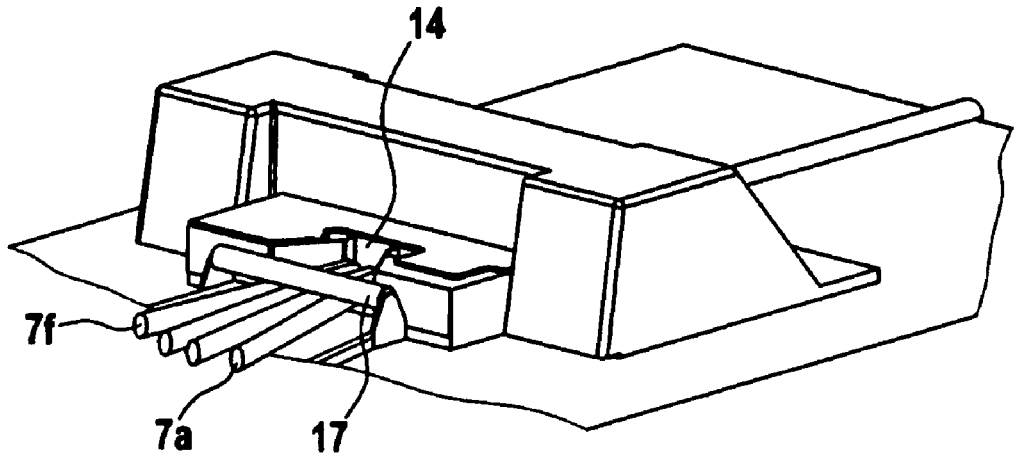
FIG. 3 is a perspective view of an embodiment having a sliver guide with a sliver-guiding device arranged upstream in accordance with the invention.

FIG. 3 shows a sliver-guiding means 17 in the form of a bar extending across the width, arranged upstream of the entry to the sliver guide 14 at a spacing therefrom. The fibre slivers 7*a* to 7*f* pass through beneath and in contact with the sliver-guiding means 17.

Figure 4:
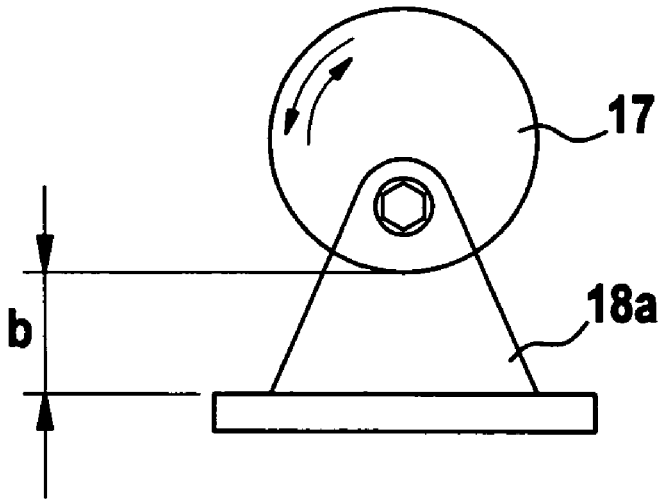
FIG. 4 is a side view of an eccentrically mounted sliver-guiding device.

FIG. 4 shows an arrangement in which the sliver-guiding means 17 is eccentrically mounted at its two ends in mountings 18*a*, 18*b* (only 18*a* is shown). As a result of rotation (see curved double arrows) the width b of the through-gap b for the fibre slivers 7 can be adjusted.

Figure 5:
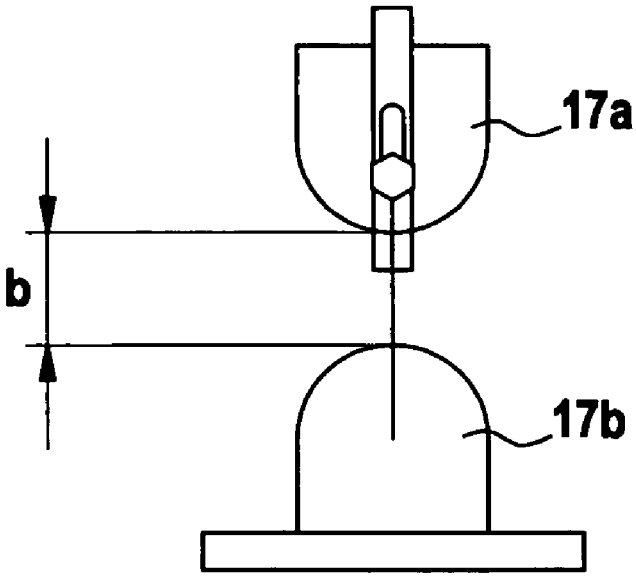
FIG. 5 is a side view of a two-sided sliver-guiding device wherein the through-gap for the slivers is adjustable.

In the embodiment of FIG. 5, the sliver-guiding means is of two-part construction wherein a lower component part 17*b* is stationary, above which the sliver-guiding means 17*a* is mounted in adjustable manner so that the width b of the through-gap for the fibre slivers 7 can be adjusted.

Figure 6B:
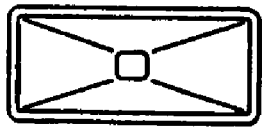
FIG. 6*b* shows in section through I-I the sliver guide according to FIG. 6*a:*
Figure 6A:
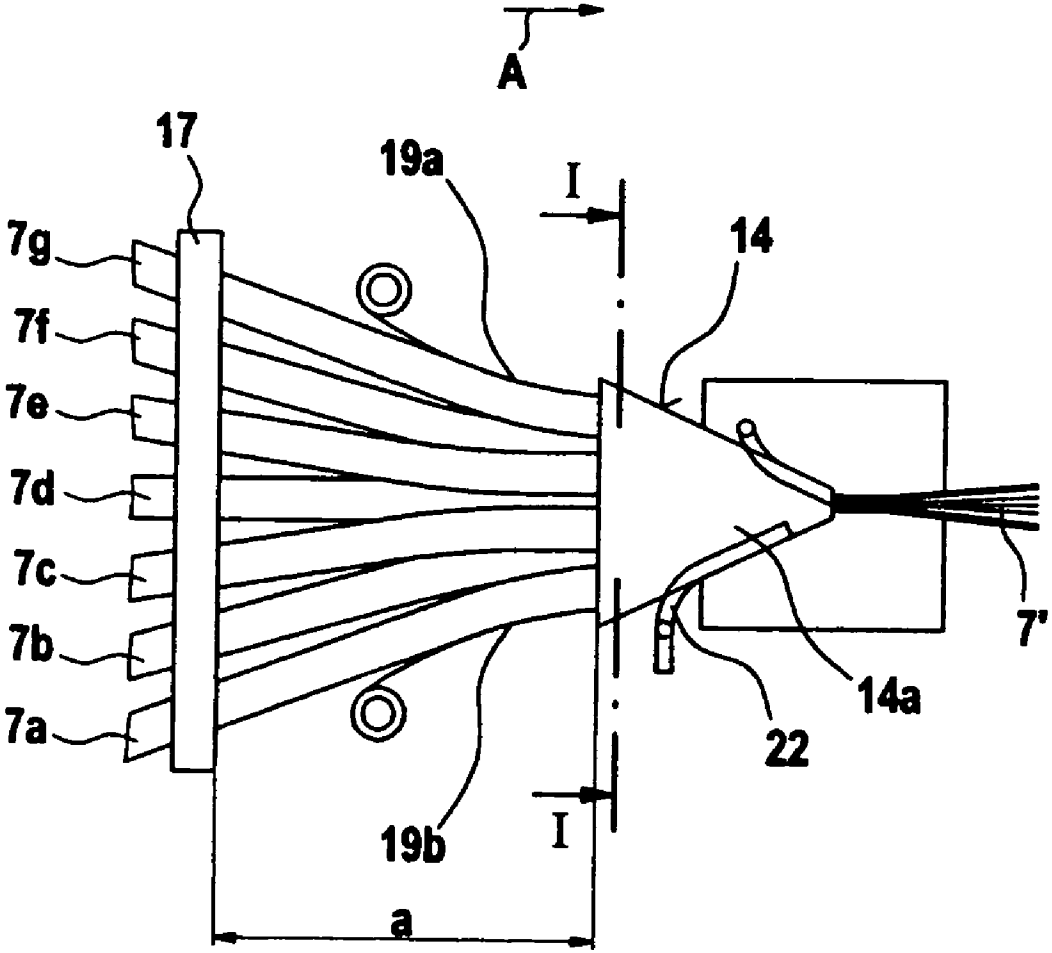
FIG. 6*a* is a top view of a sliver guide for a plurality of fibre slivers with a pre-former, upstream of which is arranged a sliver-guiding device according to the invention.
Figure 7A:
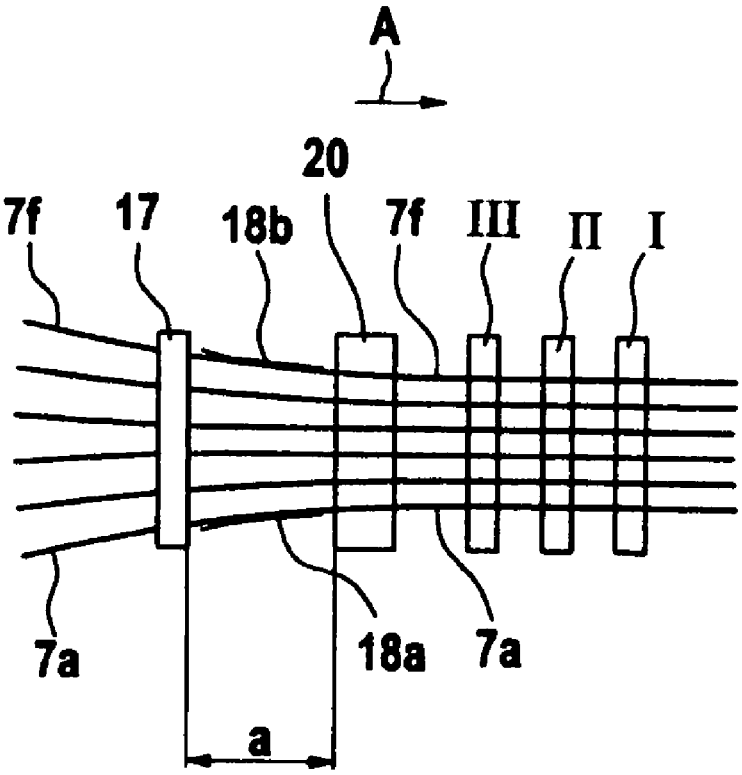
FIG. 7*a* is a top view of an individual sliver guide with a directing element and with a sliver-guiding device according to the invention arranged upstream.
Figure 7B:
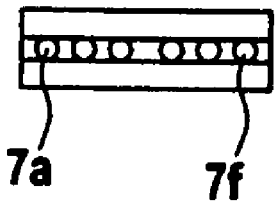
FIG. 7*b* is a front view of the individual sliver guide of FIG. 7*a* in cross-section.

In accordance with FIG. 6*a*, a pre-former 19*a*, 19*b* having two lateral faces convexly curving in towards one another is arranged upstream of the sliver guide 14. The pre-former has no top or bottom surface, that is to say it is open to the top and bottom. At one of its ends, however, the lateral faces can be pivoted around a rotary linkage about a vertical axis. The lateral faces taper towards one another in the direction of the entrance opening of the sliver guide 14. Reference numerals 7*a* to 7*g* denote the entering fibre slivers, and 7' denotes the emerging fibre slivers. Arranged upstream of the pre-former 19*a*, 19*b* at a spacing therefrom is a sliver-guiding means 17 according to the invention. FIG. 6*b* shows, in section along the line I-I in FIG. 6*a*, the inwardly tapering inner walls between the entrance and exit of the sliver guide 14. Associated with the sliver guide 14 is a sensing tongue 22 (omitted from FIG. 6*b* for the sake of clarity) for measuring the thickness of the fibre slivers. In the embodiment of FIG. 7*a*, a measuring device 20, for example a microwave measuring device, is provided for individual sliver (thickness) measurement of the fibre slivers 7*a* to 7*f*. Arranged upstream of the measuring device 20 is a two-part directing element 18*a*, 18*b*, upstream of which is a sliver-guiding means 17 according to the invention. FIG. 7*b* shows in section the measuring device 20 with the slivers 7*a* to 7*f* running therethrough.

Although the foregoing invention has been described in detail by way of illustration and example for purposes of understanding, it will be obvious that changes and modifications may be practised within the scope of the appended claims.

The invention claimed is:

1. A draw frame comprising:

a drawing mechanism;

a feed table having a plurality of supply rollers for feeding a plurality of slivers laterally spaced from one another;

a guide element located between the table and the drawing mechanism, said guide element having lateral faces for tending to cause convergence of laterally spaced slivers passing through the guide element in a direction towards said drawing mechanism;

a sliver-guiding device located upstream from the guide element and downstream from the supply rollers, the sliver-guiding device comprising a guide surface that extends across the path of the slivers; wherein in use the travelling slivers are in contact with the guide surface of the sliver-guiding device; and a sliver thickness-sensing apparatus located downstream of the sliver-guiding device and upstream of the drawing mechanism.

2. A draw frame according to claim 1, in which the fibre slivers are arranged substantially in the same plane and pass beneath, and in contact with, the guide surface.

3. A draw frame according to claim 1, in which the sliver-guiding device has an upper guide face and a lower guide face between which the slivers pass.

4. A draw frame according to claim 1, in which the spacing between the sliver-guiding device and the guide element is from about 5 mm to about 40 mm.

5. A draw frame according to claim 1, in which the sliver-guiding device is of elongate construction.

6. A draw frame according to claim 1, in which the sliver-guiding device has a circular, semi-circular or oval cross section.

7. A draw frame according to claim 6, in which the outer surface of the sliver-guiding device is generally cylindrical.

8. A draw frame according to claim 1, in which the sliver-guiding device has a smooth surface on the surface thereof which in use is in contact with the slivers.

9. A draw frame according to claim 1, in which that surface of the sliver-guiding device which is in use in contact with the slivers extends parallel to the fibre slivers.

10. A draw frame according to claim 1, in which the fibre slivers—seen in a side view—extend at an obtuse angle, relative to the direction of travel of the sliver downstream of the guide element, both before and after the sliver-guiding device.

11. A draw frame according to claim 1, in which the sliver-guiding device is mounted in the region of each of its two ends.

12. A draw frame according to claim 1, in which the sliver-guiding device is adjustable in the height direction by means of an adjusting device.

13. A draw frame according to claim 1, in which the sliver-guiding means is eccentrically mounted such that the height thereof relative to the path of travel of the slivers can be adjusted.

14. A draw frame according to claim 1, in which the sliver-guiding device comprises two members defining between them an elongate gap, the fibre slivers passing through the elongate gap between the two members.

15. A draw frame according to claim 1, in which the guide surface is concavely recessed over its length.

16. A draw frame according to claim 1, in which the guide element is the tapering sliver guide of the draw frame.

17. A draw frame according to claim 16, wherein the thickness-sensing apparatus is associated with the sliver guide and comprises a measurement funnel having a mechanical sensing lever.

18. A draw frame according to claim 16, wherein the thickness-sensing apparatus is located downstream of the sliver guide and comprises tongue and groove sensing rollers.

19. A draw frame according to claim 1, comprising a microwave sensing device adapted for individual sliver sensing.

20. A draw frame according to claim 1, in which, upstream of the guide element, there is arranged a pre-former, which is capable of bringing together laterally the fibre slivers entering the guide element and of directing them.

21. An apparatus at a draw frame for supplying fibre slivers to a drawing mechanism comprising at least two pairs of rollers, wherein the fibre slivers are fed to the drawing mechanism by a plurality of supply rollers mounted on a feed table, the fibre slivers—seen in a top view—running next to one another and towards one another laterally, and a guide element being provided between the feed table and the drawing mechanism, the lateral faces of which guide element are capable of directing the incoming fibre slivers laterally, a sliver-guiding device is arranged across the width upstream of the guide element and downstream from the supply rollers at a spacing therefrom at which the fibre slivers are arranged substantially in a plane, the fibre slivers passing through beneath and in contact with the sliver-guiding device, and a sliver thickness-sensing apparatus is located downstream of the sliver-guiding device and upstream of the drawing mechanism.

* * * * *